United States Patent [19]

Zimmermann

[11] Patent Number: 4,572,274

[45] Date of Patent: Feb. 25, 1986

[54] DEVICE FOR COMPACTING GRANULAR MOLDING MATERIALS

[75] Inventor: Rainer Zimmermann, Eschenz, Switzerland

[73] Assignee: Georg Fischer Aktiengesellschaft, Switzerland

[21] Appl. No.: 545,219

[22] Filed: Oct. 25, 1983

[30] Foreign Application Priority Data

Oct. 27, 1982 [CH] Switzerland ..... 6268/82

[51] Int. Cl.[4] ..... B22C 15/00

[52] U.S. Cl. ..... 164/169; 164/37

[58] Field of Search ..... 164/169, 37, 200–202

[56] References Cited

U.S. PATENT DOCUMENTS 2,490,559 12/1949 Taccone ..... 164/200 X
3,989,086 11/1976 Buhrer ..... 164/201 X

FOREIGN PATENT DOCUMENTS 2151949 4/1973 Fed. Rep. of Germany .
467781 8/1975 U.S.S.R. ..... 164/169
665977 6/1979 U.S.S.R. ..... 164/169

*Primary Examiner*—Kuang Y. Lin
*Assistant Examiner*—J. Reed Batten, Jr.
*Attorney, Agent, or Firm*—Roylance, Abrams, Berdo & Goodman

[57] ABSTRACT

The apparatus has a valve arrangement which opens rapidly due to priming or prestressing of the valve plate by the pressure in the pressure chamber. When the valve is closed, pressure, built up in the pressure chamber space closed by the valve, applies a force to the valve member in the direction of its open position. The valve member is held closed by a holder arrangement. Following the development of a predetermined pressure in the pressure chamber, the holder arrangement releases the valve member such that the pressure in the pressure chamber forces the valve member to its open position opening the pressure chamber passage and permitting the pressure medium to surge onto the surface of the molding material. This apparatus is suitable for all high-stressed gases which must be released suddenly.

14 Claims, 2 Drawing Figures

DEVICE FOR COMPACTING GRANULAR MOLDING MATERIALS

FIELD OF THE INVENTION

The present invention relates to an apparatus for compacting granular molding materials, particularly foundry molding materials, by applying a surge of gaseous pressure to the surface of a mass of molding material poured loosely over a molding unit. More particularly, the present invention relates to a valve arrangement in the apparatus between the pressure chamber and molding unit for quickly and suddenly releasing the pressure from the pressure chamber.

BACKGROUND OF THE INVENTION

A conventional apparatus for compacting molded material in a molding pattern unit by the pressure of compressed gas is disclosed in DE-OS No. 21 51 949. The pressurized gas from the hollow space in the housing passes through inlet and outlet openings which are located on the same axis. The flow of pressurized fluid is controlled by a valve driven by compressed gas, which valve is alternatively connected with a compressed gas source and the molding unit. The valve comprises a sheathing closed on the top with a cover having a part contacting the housing with a larger diameter than the part projecting into the hollow space. Longitudinal grooves are formed on the outer surface of the part with the larger diameter. Annular compacting cuffs are superimposed on the part with the smaller diameter. Openings are arranged radially around and at an angle relative to the longitudinal axis of the sheathing, which openings connect the sheathing space with the inner hollow space of the housing.

This conventional apparatus is disadvantageous in that only a small cross-sectional area can be opened for passage of the pressurized gas. This requires the gas pressure to be high to provide an adequate volume of gas over the molding material surface required for the compacting process within the time required. Short switching times are not possible with this device due to the valve friction.

SUMMARY OF THE INVENTION

An object of the present invention is to provide an apparatus for compacting granular molding materials, particularly foundry molding materials, which is simply constructed.

Another object of the present invention is to provide an apparatus for compacting granular molding materials, particularly foundry molding materials, by a surge of pressure of a gaseous medium wherein the pressure necessary for conveying the required volume of gas for the compacting process is minimized and the greatest possible cross-sectional area for the flow through passage is provided between the pressure chamber and the surface of the molding material.

A further object of the present invention is to provide an apparatus for compacting granular molding materials, particularly foundry molding materials, by a surge of pressure of a gaseous medium wherein the moveable parts have low internal friction such that a valve between the pressure chamber and molding unit can be open abruptly.

The foregoing objects are obtained by an apparatus for compacting granular molding materials, particularly foundry molding materials, by a surge of pressure of a gaseous medium, comprising a pressure chamber which can form a closed system at a pressure chamber outlet with a molding unit in which molding material has been loosely poured, a passage providing fluid communication between the pressure chamber and the outlet, and a valve member. The passage has a valve seat facing away from the pressure chamber. The valve member is moveable between an open position spaced from the valve seat and a closed position engaging the valve seat to close the passage. A valve rod is coupled to the valve member and controls its movement. A holding arrangement releaseably engages and retains the valve rod such that the valve member is held in its closed position, and releases the valve rod and valve member for movement to the open position under action of the fluid pressure in the pressure chamber.

By forming the apparatus in this manner, the passage is quickly opened permitting fluid pressure from the pressure chamber to pass into the molding unit for compacting the molding materials. Additionally, the apparatus is simply constructed and permits use of relatively low pressures for conveying the volume of gas required for the compacting process.

Other objects, advantages and salient features of the present invention will become apparent from the following detailed description, which, taken in conjunction with the annexed drawings, discloses preferred embodiments of the invention.

BRIEF DESCRIPTION OF THE DRAWINGS

Referring to the drawings which form a part of this disclosure.

DETAILED DESCRIPTION OF PREFERRED EMBODIMENTS OF THE INVENTION

Figure 1:
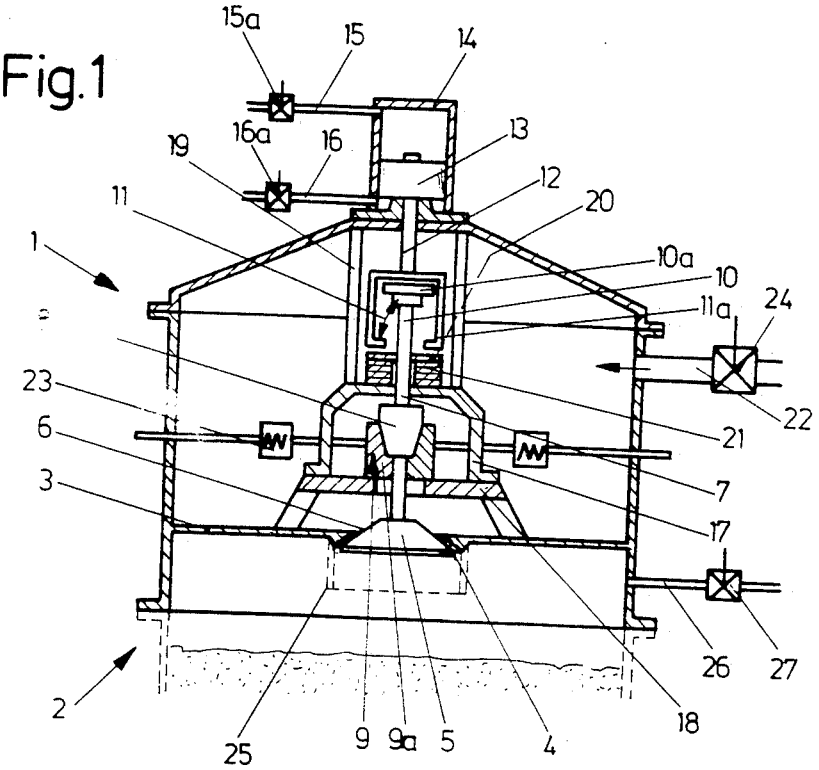
FIG. 1 is a side elevational view in section of an apparatus for compacting granular molding materials according to the present invention with the valve in the closed position.

Referring to the drawings, the apparatus for compacting granular molding materials of the present invention comprises a pressure chamber 1 which can be connected to a molding unit 2 in which molding material has been loosely poured. The molding unit comprises a molding box and pattern. Pressure chamber 1 is separated from molding unit 2 by a partition wall 3 formed as part of the pressure chamber. Partition wall 3 has an opening or passage 4 providing fluid communication between the pressure chamber and the molding unit 2 to permit a gaseous medium from pressure chamber 1 to pass into molding unit 2. Opening 4 can be closed by a valve member 5. In the illustrated embodiment, a ball valve with conical packing or seating surfaces 6 is moved against the valve seat or packing part of opening 4 in its closed position. Alternatively, other types of valves can be used instead of the ball valve, e.g., a plate valve or the like. The valve seat faces away from the pressure chamber.

Valve member 5 is connected to a valve rod 7. The free end 10 of valve rod 7 is connected through a delayed-action switch 11 with a piston thrust drive 14. Piston thrust drive 14 is mounted on pressure chamber 1 and restores the valve member 5 to its closed position. Feed lines 15 and 16 for conveying a fluid pressure medium are coupled to piston thrust drive 14 in the space housing thrust piston 13. The flow of fluid through the lines is controlled by valves 15*a* and 16*a*. The medium controlling movement of thrust piston 13 can be gaseous or liquid. The operating pressure for thrust piston drive 14 is adjusted according to the force required for lifting and closing valve member 5.

For closing valve member 5, free end 10 of valve rod 7 has a follower 10*a*. A stem 11*a* of the delayed-action switch engages valve rod 7 by engaging follower 10*a*. Stem 11*a* is connected to thrust rod 12 which supports thrust piston 13 and is held against relative rotation by longitudinal guides 19. Valve rod 7 and thrust rod 11 are coaxially aligned with each other.

Follower 10*a* functions as a stud or stop limiting movement of valve member 5. For limiting this movement, a flexible element 21, e.g., an elastomer, is mounted within pressure chamber 1 and surrounds valve rod 7. A metal plate 20 covers the flexible element for engaging and holding the stud or stop. A housing 17 which surrounds a holder arrangement 9 supports flexible element 21. The housing is mounted on a carrier plate 18, which plate is connected to and supported on partition wall 3.

The holder arrangement for releaseably engaging valve rod 7 comprises an enlargement 8 formed as a shoulder-like projection attached to valve rod 7 and clamp elements 9*a* which support enlargement 8. Clamp elements 9*a* are slideably mounted on carrier plate 18. Switch elements 23 coupled to the clamp elements 9*a* open and close holder 9 and are mechanically, pneumatically, hydraulically or electrically powered. Alternatively, a different holder arrangement can be employed wherein valve rod 7 is held by static friction such that the valve member is located in its closed position, and then is released in a sliding frictional engagement with the holder arrangement to permit the valve member to move to its open position.

Accelerator supports 25 can depend about opening 4 and about the periphery of valve member 5. Valve member 5 extends through the accelerator supports when opened under the force of the pressure from the pressure chamber. This arrangement optimally accelerates the opening of the valve member.

A line 22 extends through a wall of pressure chamber 1 and into the pressure chamber space. Line 22 is connected through a valve 24 with a source of compressed or pressurized gas.

A line 26 extends into the space between the pressure chamber and the molding unit, i.e., on the side of partition wall 3 remote from the pressure space. A valve 27 connects such space with the atmosphere through line 26. In this manner, residual pressure remaining over the molding material after the compacting process can be discharged to the atmosphere by opening valve 27.

Figure 2:
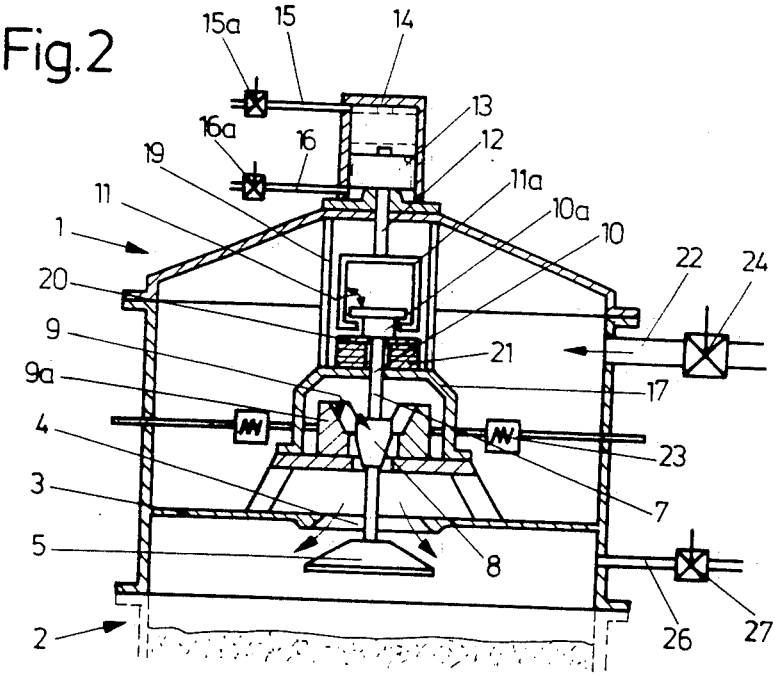
FIG. 2 is a side elevational view in section of the apparatus of FIG. 1 with the valve in its open position.

In operation, the apparatus is initially oriented as illustrated in FIG. 1. A fluid medium, preferably a gaseous medium such as compressed air, is fed through line 22 into pressure chamber 1 developing a pressure of at least 1.2 bar, e.g., of six bar. This pressure applies a downward or opening force on valve member 5 placing valve member 5 in a prestessed or primed condition. When the predetermined pressure is reached in the pressure chamber, switch elements 23 are actuated and clamp elements 9*a* are disengaged from enlargement 8 to release valve rod 7 for movement. Due to the priming or prestressing of the valve member resulting from the pressure on valve member 5, the pressure in the pressure chamber forces the valve member in the direction of the molding unit to its open position, as illustrated in FIG. 2, in a sudden manner such that passage 4 is suddenly opened for release of the gaseous medium. In this manner, the gaseous medium can be suddenly discharged from the pressure chamber to develop a pressure surge for compacting the molding material.

After the molding material has been compacted, fluid pressure is supplied through line 16 to thrust piston drive 14 raising piston 13. Piston 13 raises valve rod 7 and valve member 5 through the connection of stem 11*a* and follower 10*a* such that the valve rod and valve member are moved into their closed position. The clamp elements 9*a* are then actuated such that the holder arrangement 9 engages enlargement 8 and valve rod 7 maintains valve member 5 in its closed position in engagement with the valve seat of the passage or opening 4. As noted above, a holding arrangement which frictionally engages the valve rod can be employed, in lieu of clamp elements 9*a*. Once the valve member has been moved to its closed position sealing opening 4, the pressure in pressure chamber 1 can be built up again. Thrust piston drive 14 operates to move valve member 5 back to its closed position, and also prevents accidental operation of valve member 5 by biasing piston 13 upwardly.

The apparatus of the present invention is advantageous in that it prestresses or primes the valve member. The valve member, upon release from the holder arrangement, suddenly and completely opens the passage. The sudden opening of the passage permits the gaseous medium held under pressure within the pressure chamber to form a surge of pressure on the surface of the loosely poured mass of molding material in the molding unit.

The opening of the valve arrangement of the apparatus of the present invention is not affected by friction which must be overcome during opening of the valve. This feature is obtained by the proper selection of the holder arrangement for the valve rod.

While various embodimens have been chosen to illustrate the invention, it will be understood by those skilled in the art that various changes and modifications can be made therein without departing from the scope of the invention as defined in the appended claims.

What is claimed is:

1. An apparatus for compacting granular molding materials, particularly foundry molding materials, by a surge of pressure of a gaseous medium, comprising:

a pressure chamber having coupling means, mounted at an outlet of said pressure chamber, for forming a closed system with a molding unit in which molding material has been loosely poured;

a passage providing fluid communication between said pressure chamber and said outlet, and having a valve seat facing away from said pressure chamber;

a valve member moveable between an open position spaced from said valve seat and a closed position engaging said valve seat and closing said passage;

a valve rod coupled to said valve member and controlling movement thereof; and closure means, coupled to said valve rod, for moving said valve member from said open position toward said closed position;

holding means for releasably engaging and retaining said valve rod such that said valve member is held in said closed position and for releasing said valve rod and said valve member for movement to said open position by fluid pressure in said pressure chamber, said holding means being separate from and independent of said closure means;

whereby said passage is quickly opened for passage of fluid pressure from said pressure chamber to the molding unit.

2. An apparatus according to claim 1 wherein said holding means comprises clamp elements which retain said valve rod in position by a stationary frictional engagement and which release said valve rod by forming a sliding frictional engagement therebetween.

3. An apparatus according to claim 1 wherein said holding means comprises means for guiding said valve rod; and said valve rod has separated first and second parts, said first part being connected to a piston, said second part being connected to a follower, said first part being movably coupled to said follower.

4. An apparatus according to claim 1 wherein said valve member is connected to a piston thrust drive by said valve rod, said valve rod having a delayed-action switch between said valve member and said piston thrust drive.

5. An apparatus according to claim 1 wherein said holding means is hydraulically operated.

6. An apparatus according to claim 1 wherein said holding means is pneumatically operated.

7. An apparatus according to claim 1 wherein said holding means is electrically operated.

8. An apparatus according to claim 1 wherein accelerator supports extend about the periphery of said valve member and in a direction away from said pressure chamber.

9. An apparatus according to claim 1 wherein said holding means releases said valve rod when pressure in said pressure chamber is at least 1.2 bar.

10. An apparatus according to claim 1 wherein said holding means comprise at least one clamp element which moves radially relative to said valve rod.

11. An apparatus according to claim 1 wherein said holding means comprise clamp elements which move radially relative to said valve rod.

12. An apparatus according to claim 1 wherein said closure means is coupled to said valve rod by a follower and a stem, said follower and stem being relatively movable through a limited distance substantially corresponding to a distance traveled by said valve member in moving between said open and closed positions, such that said valve member can move independently of said closure means when said valve member moves from said closed position to said open position.

13. An apparatus according to claim 1 wherein said valve rod comprises an enlargement between said valve member and said closure means for releasably engaging said holding means.

14. An apparatus for compacting granular molding materials, particularly foundry molding materials, by a surge of pressure of a gaseous medium, comprising:

a pressure chamber having coupling means, mounted at an outlet of said pressure chamber, for forming a closed system with a molding unit in which molding material has been loosely poured;

a passage providing fluid communication between said pressure chamber and said outlet, and having a valve seat facing away from said pressure chamber;

a valve member moveable between an open position spaced from said valve seat and a closed position engaging said valve seat and closing said passage;

a valve rod coupled to said valve member and controlling movement thereof; and holding means for releasably engaging and retaining said valve rod such that said valve member is held in said closed position and for releasing said valve rod and said valve member for movement to said open position by fluid pressure in said pressure chamber, said holding means including clamp elements which retain said valve rod in position by a stationary frictional engagement and which release said valve rod by forming a sliding frictional engagement therebetween;

whereby said passage is quickly opened for passage of fluid pressure from said pressure chamber to the molding unit.

* * * * *